US005436525A

United States Patent [19]

Theiss

[11] Patent Number: 5,436,525

[45] Date of Patent: Jul. 25, 1995

[54] HIGHLY DEPRESSED, HIGH THERMAL CAPACITY, CONDUCTION COOLED COLLECTOR

[75] Inventor: Alan J. Theiss, San Carlos, Calif.

[73] Assignee: Litton Systems, Inc., Beverly Hills, Calif.

[21] Appl. No.: 985,575

[22] Filed: Dec. 3, 1992

[51] Int. Cl.[6] ..... H01J 23/02

[52] U.S. Cl. ..... 315/5.38; 313/46

[58] Field of Search ..... 315/5.38; 313/46

[56] References Cited

U.S. PATENT DOCUMENTS

| | | | |
|---|---|---|---|
| 3,612,934 | 10/1971 | Henry | 315/5.38 X |
| 3,626,230 | 12/1971 | Stewart | 315/538 X |
| 3,644,778 | 2/1972 | Mihran et al. | 315/5.38 |
| 3,679,929 | 7/1972 | Holm et al. | 315/5.38 |
| 3,824,425 | 7/1974 | Rawls, Jr. | 315/5.38 X |
| 4,107,574 | 8/1978 | Ruf et al. | 315/5.38 X |
| 4,358,707 | 11/1982 | Delory et al. | 315/5.38 |
| 4,794,303 | 12/1988 | Hechtel et al. | 315/5.38 |
| 5,025,193 | 6/1991 | James | 315/5.38 |

FOREIGN PATENT DOCUMENTS

| | | | |
|---|---|---|---|
| 0276933A1 | 8/1988 | European Pat. Off. . | |
| 159933 | 6/1989 | Japan | 315/5.38 |
| 1341119 | 12/1973 | United Kingdom . | |
| 1376579 | 12/1974 | United Kingdom . | |

*Primary Examiner*—Benny T. Lee
*Attorney, Agent, or Firm*—Graham & James

[57] ABSTRACT

An electron collector is provided for collecting spent electrons generated by a charged particle device after passage though an interaction region of a RF circuit. The collector has a centerline and comprises an outer structure which is coupled to the RF circuit. An inner structure is within the outer structure, and receives the spent electrons. A negative voltage is applied to the inner structure, which forms an electric field between the inner and outer structures. A plurality of thermally conductive and electrically insulative standoff assemblies extend between the outer and inner structures. Each of the assemblies comprise a ceramic planar member centered within outer walls providing a double-ended cup shape, and conductive plugs which adjoin each side of the planar member with the respective one of the inner and outer structures. An axis of symmetry of the assemblies lies perpendicular to a radial vector extending from the centerline, and lies parallel to the electric field vector. Since the conductive plugs are partially surrounded by the outer walls, a relatively long surface voltage breakdown path is provided between the plugs, while the thermal path through the planar member is relatively short.

19 Claims, 3 Drawing Sheets

FIG. 2
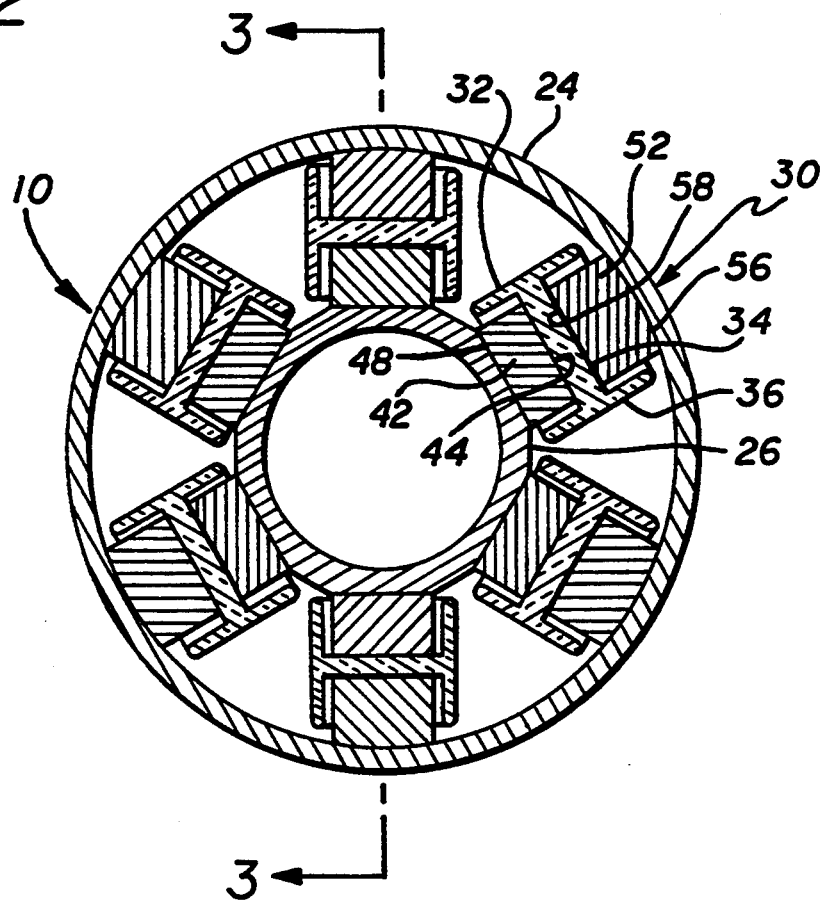
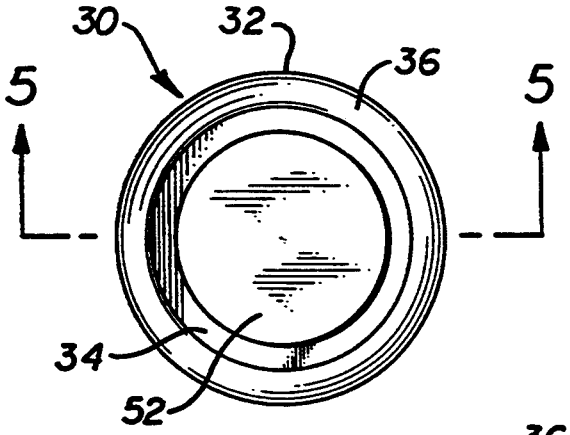
FIG. 4
FIG. 5
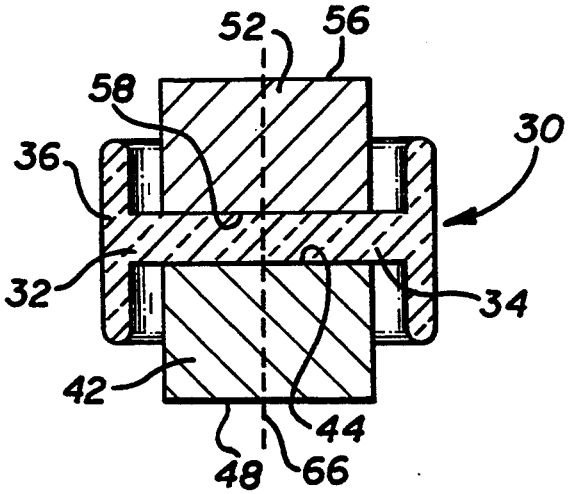

HIGHLY DEPRESSED, HIGH THERMAL CAPACITY, CONDUCTION COOLED COLLECTOR

BACKGROUND OF THE INVENTION

1. Field of the Invention

The present invention relates to an improved electron beam collector and, more particularly, to a conduction cooled collector capable of highly depressed operation without voltage breakdown.

2. Description of Related Art

Many electronic devices employ a travelling stream of charged particles, such as electrons, formed into a beam as an essential function in the device's operation. In a linear beam device, an electron beam originating from an electron gun is caused to propagate through a tunnel, or drift tube, generally containing an RF interaction structure. Within the interaction structure, the beam must be focused by magnetic or electrostatic fields in order for it to be effectively transported through the interaction structure without energy loss. In the interaction structure, kinetic energy is transferred from the moving electrons of the beam to an electromagnetic wave that is propagating through the interaction region at approximately the same velocity as the moving electrons. The electrons give up energy to the electromagnetic wave through an exchange process characterized as electron beam interaction, which is evident by a reduced velocity of the electron beam from the interaction region.

These "spent" electrons pass out of the interaction region where they are incident upon and collected by a final element, termed the collector. The collector collects and returns the incident electrons to the voltage source. Much of the remaining energy in the charged particles is released in the form of heat when the particles strike a stationary element, such as the walls of the collector.

The electron collector can either be mounted directly to the body of the RF device containing the RF interaction structure, or can be electrically isolated from the structure. Isolated collectors are capable of operating at a significantly lower voltage than that of the RF device, and are known as depressed collectors. By operating the collector at a depressed state, the electric field within the collector slows the moving electrons so that the electrons can be collected at a reduced velocity. This method increases the electrical efficiency of the RF device as well as reducing undesirable heat generation within the collector. Depressed collectors are discussed in U.S. Pat. No. 4,794,303, by Hechtel et al., which is assigned to the same assignee as the present invention, and which is incorporated herein by reference.

A depressed collector typically comprises an outer metallic structure which is fixed to the RF device and forms part of the vacuum envelope of the interaction region. An inner metallic structure is centered within the outer structure, and serves as the recipient of the electron beam. These collector structures are often cylindrical shaped, but other alternative shapes are employed. To hold the inner structure in place, and to provide thermal conductivity and electrical isolation, standoff assemblies are provided which join the outer and inner structures. The standoff assemblies must provide for the conduction of heat from the inner structure to the outer structure, so that the heat can be ultimately removed from the device.

To provide the depressed electric field in the inner structure, a highly negative voltage is applied to the inner structure. Since the voltage of the outer structure is equivalent to that of the RF device, a voltage differential exists between the inner and outer collector structures, creating an electric field between the structures. The standoff assembly must be highly electrically insulative in order to prevent electrical conduction between the structures. If the voltage differential becomes too large, a breakdown condition can occur in which electrical arcing bridges across the surface of one or more of the standoff assemblies. This breakdown condition would significantly reduce the effectiveness of the depressed collector, and in some cases could damage the structure.

To provide the requisite electrical insulative quality, ceramic materials are typically used in the standoff assembly. These ceramic components can take a variety of forms, including solid sheets of ceramic material which partially or completely fill the field space, spheres which are uniformly arrayed inside the field space, and rectangular pads contoured to maximize the voltage standoff. However, these prior art standoff designs have met with less than desirable results due to the large voltages and thermal loads experienced with modern RF devices. The sheet ceramic designs are typically unable to handle high thermal loads without cracking. The sphere or pad shape designs are not able to hold off large voltage differentials without arcing. Thus the prior art standoff designs have been unable to achieve acceptable levels of both thermal conductivity and voltage breakdown resistance.

Therefore, it would be desirable to provide a highly depressed, conduction cooled collector having high thermal conduction capacity and voltage breakdown resistance. It would also be desirable to provide a depressed collector having a standoff design which combines a short thermal path through the standoff with a long voltage breakdown path across the surface of the standoff.

SUMMARY OF THE INVENTION

Accordingly, a principle object of the present invention is to provide a highly depressed, conduction cooled collector having acceptable thermal conduction capacity and voltage breakdown resistance.

Another object of the present invention is to provide a standoff design for a conduction cooled collector which combines a short thermal path through the standoff with a relatively long electrical conduction path across the surface of the standoff.

To achieve the foregoing objects, and in accordance with the purpose of the invention, an electron collector is provided for collecting spent electrons generated by a charged particle device after passage through an interaction region of an RF circuit. The collector comprises an outer collector structure which is coupled to the RF circuit. An inner collector structure is disposed within the outer structure, and receives the spent electrons. A negative voltage is applied to the inner structure, which creates an electric field between the inner structure and the outer structure. A plurality of thermally conductive and electrically insulative standoff assemblies extend between the outer and the inner structures. Each of the assemblies comprises an electrically non-conducting planar member centered within an electrically non-conducting outer wall, and thermally and electrically conductive plugs which adjoin each side of the planar member with a respective one of the collector structures. An axis of symmetry of each assembly lies parallel to an electric field vector defined by the electric field between the outer and the inner collector structures. Since the conductive plugs are partially surrounded by the outer walls, a relatively long breakdown voltage path is provided between the plugs, while a relatively short thermal path is provided across the width of the planar member.

In a preferred embodiment of the present invention, the collector structures are cylindrically shaped, with the inner structure being concentrically disposed within the outer structure. The standoff assemblies extend radially between the inner and outer collector structures. The planar member is disc-shaped and the outer wall is generally cylindrical, providing a double-ended cup shape. The planar member and outer wall are unitarily constructed together of a ceramic material having the desired electrically non-conducting properties.

A more complete understanding of the highly depressed, high thermal capacity conduction cooled collector of the present invention will be afforded to those skilled in the art, as well as a realization of additional advantages and objects thereof, by a consideration of the following Detailed Description of the Preferred Embodiment. Reference will be made to the appended sheets of drawings which will first be described briefly.

BRIEF DESCRIPTION OF THE DRAWINGS

FIG. 2 is a sectional view of the conduction cooled collector as taken through the section 2—2 of FIG. 1;

FIG. 4 is an end view of a standoff assembly for the conduction cooled collector; and FIG. 5 is a sectional side view of the standoff assembly as taken through the section 5—5 of FIG. 4.

DETAILED DESCRIPTION OF THE PREFERRED EMBODIMENT

Figure 1:
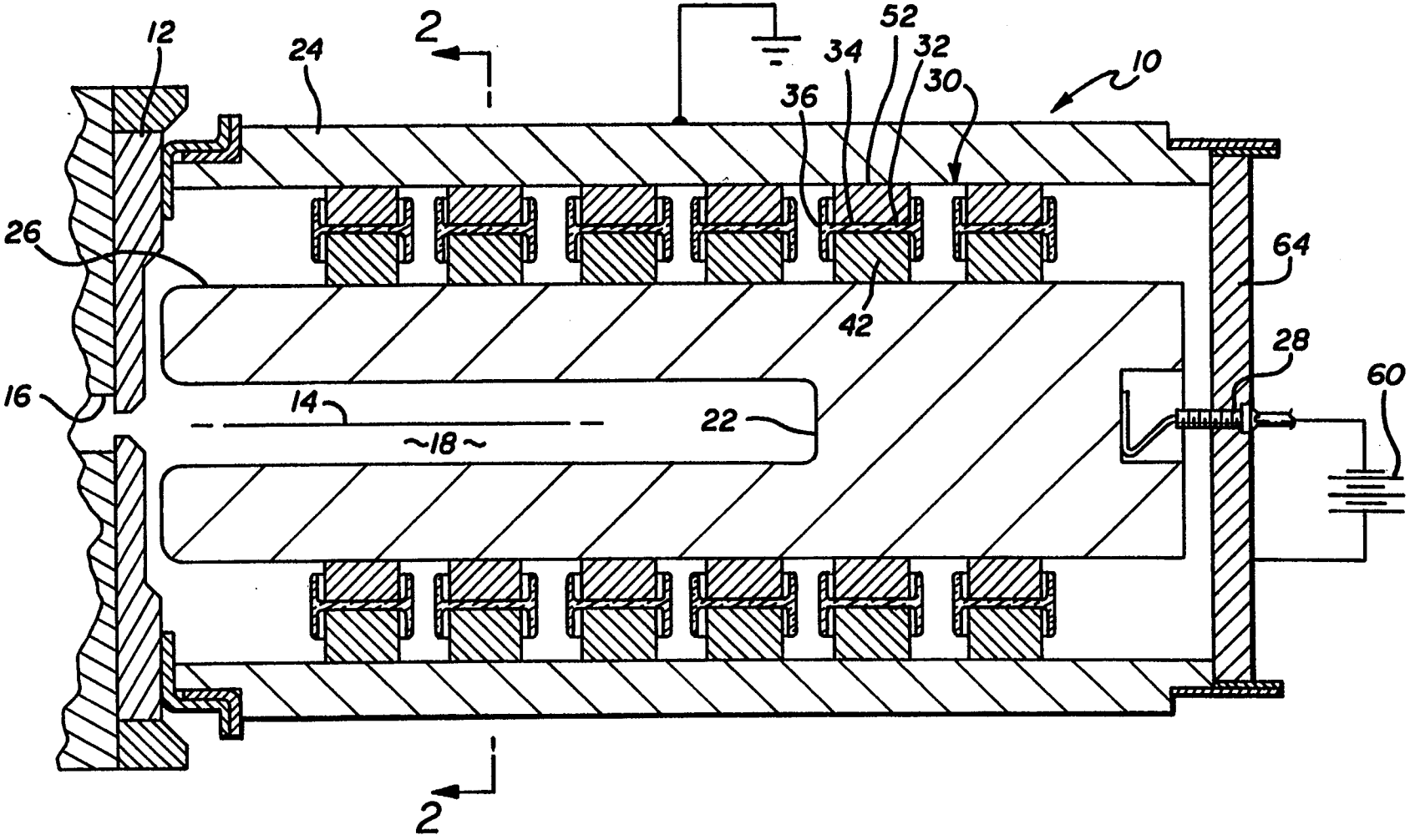
FIG. 1 is a sectional view of the conduction cooled collector of the present invention coupled to an exemplary RF device.
Figure 3:
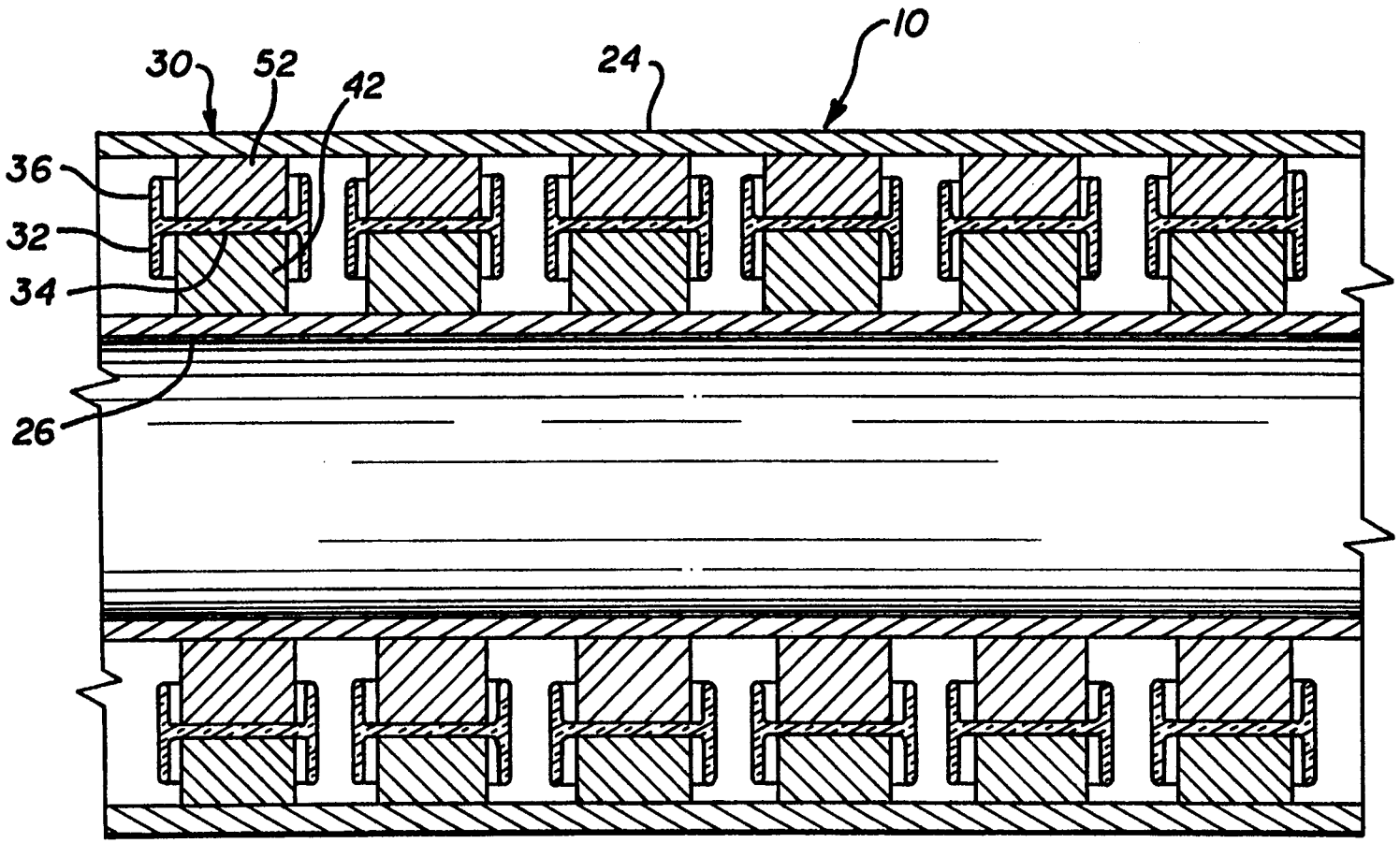
FIG. 3 is a side view of the conduction cooled collector as taken through the section 3—3 of FIG. 2.

Referring first to FIGS. 1 through 3, there is shown a conduction cooled collector 10 of the present invention. As illustrated in FIG. 1, the collector 10 is coupled to a RF device 12 having an interaction region 16 and a centerline 14. As known in the art, an electron beam is projected through the interaction region 16 along the centerline 14, in which it transfers energy to an electromagnetic wave propagating through the RF device 12. After passing through the RF device 12, the electron beam exits the device and enters a bucket region 18 of the collector 10. Rather than following along the centerline 14, the spent electrons of the beam dissipate by striking the inner surfaces of the bucket region 18 and the back end 22 of the bucket.

It is anticipated that the collector 10 operate in a highly depressed mode, so as to enhance dissipation of the spent electrons exiting the RF device 12. To depress the collector 10, the collector includes an outer structure 24 (See FIGS. 1, 3) and an inner structure 26. The inner structure 26 is disposed within the outer structure 24 by a predetermined magnitude of separation. In the preferred embodiment of the present invention, the collector structures are cylindrical shaped, with the inner structure 26 concentrically disposed within the outer structure 24.

FIG. 1 illustrates an electrical feedthrough 28 that extends through the back panel 64, and provides a voltage from an external voltage source 60 to the inner structure 26. The feedthrough 28 has an insulated sleeve surrounding a wire which electrically connects the inner structure to the voltage source 60. The voltage provided to the inner cylinder 26 is highly negative with respect to the outer cylinder 24, which is electrically connected to the RF device 12 and to ground. It is anticipated that the voltage applied to the inner cylinder 26 be approximately −15,000 volts when the separation between the inner structure 26 and outer structure 24 is approximately 0.4 inches. Due to this significant voltage differential, an electric field forms between the inner structure 26 and the outer structure 24.

A plurality of standoff assemblies 30 secure the inner structure 26 within the outer structure 24. In the preferred embodiment, the standoff assemblies 30 extend radially between the inner and outer structures 26 and 24, and suspend the inner structure in place within the outer structure. The purpose of the standoff assemblies is to conduct heat from the inner structure 26 to the outer structure 24, and to provide electrical isolation of the inner structure. Heat conducted into the outer structure 26 can then be eliminated from the system by known convection, conduction or radiation techniques. The standoff assemblies 30 also must provide electrical isolation of the inner structure 26 both by preventing surface breakdown across the standoff assemblies and direct breakdown across the vacuum separation between the outer structure 24 and inner structure 26. Thus, the standoff assemblies must be highly electrically insulative and thermally conductive.

Referring now to FIGS. 4 and 5, there is shown the standoff assemblies 30 in greater detail. Each of the assemblies comprises an insulator 32, and a pair of plugs 42 and 52 (See FIGS. 1 and 5), The standoff assemblies 30 are constructed having an axis of symmetry 66 (See FIG. 5) that extends vertically through a radial centerline of the planar member 34. In an embodiment of the present invention, it is anticipated that the standoff assemblies 30 be approximately 0.5 inches in diameter.

The insulator 32 has a planar member 34 centered within art outer wall 36, constituting a double-ended cup shape (See FIGS. 1, 2, 3 and 5). In the preferred embodiment, the planar member 34 is round and the outer wall 36 is cylindrical shaped. It should be apparent that a round shape for the insulator 32 would be particularly conducive to known fabrication techniques. However, it is also anticipated that alternative shapes for the planar member 34 and outer wall 36 be advantageously used, such as rectangular.

In the preferred embodiment, the insulator 32 would be made of a ceramic material such as beryllium oxide, and the planar member 34 and the outer wall 36 would be unitarily constructed together from a single ceramic slug. However, it should be apparent that the two components can also be constructed individually and combined during manufacture. As illustrated in FIG. 5, the planar members 34 are disposed such that the axis of symmetry 66 of the assembly 30 would be parallel to the electric field vector. This positioning reduces the possibility of surface breakdown across the insulator 32. In a configuration utilizing a cylindrical inner structure 26 within a cylindrical outer structure 24 as shown in FIG. 3, the axis of symmetry 66 would lie parallel to a radial vector from the centerline 14 of the collector 10. Since the electric field between the inner structure 26 and outer structure 24 is radially directed, the axis of symmetry would lie parallel to the electric field vector.

The thickness of the planar member 34 (See FIG. 5) must be selected so as to balance the thermal, electrical and structural demands on the component. Since the planar member 34 is additionally susceptible to bulk breakdown directly through its ceramic material, increasing the thickness of the material increases its resistance to bulk breakdown. In addition, increased thickness of the planar member 34 reduces the possibility of structural damage to the insulator 32, i.e. cracking. However, if the thickness is increased too much, the thermal conductivity of the standoff assembly 30 degrades. In a preferred embodiment of the present invention, the thickness of the planar member 34 is approximately 0.070 inches.

Both the inner plug 42 and the outer plug 52 are made of an electrically and thermally conductive material, and join the insulator 32 to the outer structure 24 and inner structure 26, respectively. The inner plug 42 has a first surface 44 which contacts the planar member 34 and a second surface 48 which contacts the outside surface of the inner structure 26. Conversely, the outer plug 52 has a first surface 56 which contacts the inside surface of the outer structure 24, and a second surface 58 which contacts the planar member 34. It is anticipated that the plugs 42, 52 secure to the insulator by a known fastening technique, such as brazing. The plugs 42, 52 can also be brazed to the inner and outer cylinders 26, 24, respectively, or can be attached by other fastening techniques, such as by screws or bolts.

The diameter of the outer wall 36 of the insulator 32 is slightly larger than that of the plugs 42, 52, so that a gap is created between them. This gap provides a number of important functions. A lengthy surface breakdown path is provided between the inner plug 42 and the outer plug 52. Surface voltage breakdown must travel from the plug to the planar member 34, to the inner portion of the outer wall 36, then across the outer portion of the outer wall and back again to the inner portion of the outer wall, and finally across the planar member to reach the outer plug 52. The gap also allows for thermal expansion of the plugs due to the high temperatures experienced within the collector 10.

Having thus described a preferred embodiment of a conduction cooled collector capable of highly depressed operation without voltage breakdown, it should now be apparent to those skilled in the art that the aforestated objects and advantages for the within system have been achieved. It should also be appreciated by those skilled in the art that various modifications, adaptations and alternative embodiments thereof may be made within the scope and spirit of the present invention. For example, the figures show a collector configuration having six standoff assemblies 30 disposed radially about the inner cylinder 26, with six rows of standoff assemblies extending along the length of the cylinder. The collector can also have alternative shapes besides cylindrical, including rectangular or planar configurations. It should be apparent that differing numbers and location of standoff assemblies can be advantageously used depending on the size and shape of the collector.

The present invention is further defined by the following claims:

What is claimed is:

1. An electron collector comprising:

an outer structure coupled to ground;

an inner structure disposed within the outer structure; and a plurality of thermally conductive and electrically insulative standoff assemblies extending between said outer and inner structures, each of said assemblies comprising a planar member and an outer wall, said outer wall peripherally enclosing an internal region, said planar member spanning across said internal region from an inner surface of said outer wall, and respective conductive plugs adjoining said planar member with a corresponding one of said inner and outer structures such that a first one of said conductive plugs extends between an inner surface of said outer structure and said planar member, and a second one of said conductive plugs extends between an outer surface of said inner structure and said planar member; and means for providing a negative voltage to said inner structure, said voltage thereby producing an electric field between said inner and outer structures.

2. The electron collector of claim 1, wherein said plugs of each standoff assembly are partially surrounded by the corresponding outer wall thereof for providing a relatively long surface voltage breakdown path between each of said plugs.

3. The electron collector of claim 1, wherein each of said planar members are comprised of beryllium oxide ceramic material.

4. The electron collector of claim 1, wherein each of said plugs are comprised of copper material.

5. The electron collector of claim 1, wherein said inner and outer structures are generally cylindrical shaped having a common centerline such that said inner structure is concentrically disposed within said outer structure.

6. The electron collector of claim 5, wherein each of said standoff assemblies extend radially between said inner and outer structures.

7. The electron collector of claim 1, wherein each of said standoff assemblies have an axis of symmetry which lies perpendicular to a common centerline of said inner and outer structures.

8. The electron collector of claim 7, wherein each of said axes of symmetry lies perpendicular to a corresponding electric field vector defined by said electric field.

9. The electron collector of claim 1, wherein each of said plugs provide thermal coupling to said corresponding planar members.

10. In an electron collector operatively connected to a charged particle device having an interaction region, said collector collecting spent electrons generated by said charged particle device after passage of said electrons through said interaction region, the collector having a centerline and comprising an outer structure coupled to the charged particle device, and an inner structure disposed within the outer structure and positioned to receive said spent electrons, said collector further having a voltage applied to said inner structure thereby producing an electric field between said inner and outer structures, the improvement comprising:

thermally conductive and electrically insulative means for suspending said inner structure within said outer structure, said means comprising a plurality of standoff assemblies extending radially between said outer and inner structures, each of said assemblies comprising an outer peripheral wall and a planar member spanning perpendicularly across a region enclosed by the peripheral wall at a central point along an axial extent of said peripheral wall, and means for coupling said planar member to said inner structure and said outer structure, respectively;

wherein each of said standoff assemblies has an axis of symmetry which lies perpendicular to said centerline.

11. The improvement of claim 10, wherein each of said coupling means further comprises conductive plugs respectively adjoining said corresponding planar members, a first one of said conductive plugs respectively coupling said planar member to said outer structure and a second one of said conductive plugs respectively coupling said planar member to said inner structure.

12. The improvement of claim 11, wherein said plugs of each standoff assembly are partially surrounded by the corresponding outer wall thereof for providing a relatively long voltage breakdown path between each of said plugs.

13. The improvement of claim 10, wherein each of said planar members are comprised of beryllium oxide ceramic material.

14. The improvement of claim 10, wherein said inner and outer structures are generally cylindrical shaped and are symmetrical about said centerline, said inner structure being concentrically disposed within said outer structure.

15. The improvement of claim 14, wherein each of said standoff assemblies extend radially between said inner and outer structures.

16. An electron collector having a centerline and comprising:

an outer structure, and an inner structure disposed within the outer structure;

means for providing a negative voltage to said inner structure, said voltage producing an electric field between said inner and outer structures;

means for connecting said inner and outer structures, said connecting means conducting heat between said inner and outer structures, and preventing electrical breakdown between said structures due to said electric field, the connecting means having an axis of symmetry which extends radially from said centerline, wherein said connecting means further comprises a plurality of standoff assemblies, each of said standoff assemblies comprising:

a planar member and an outer peripheral wall, said planar member lying perpendicular to said axis of symmetry at a central point along an axial extent of said peripheral wall, and conductive plugs respectively coupling said planar member between said inner and outer structures;

wherein said plugs are partially surrounded by said outer peripheral wall, thereby providing a relatively long surface voltage breakdown path between said plugs.

17. An electron collector having a centerline and comprising:

an outer structure, and an inner structure disposed within the outer structure;

means for providing a negative voltage to said inner structure, said voltage producing an electric field between said inner and outer structures;

means for connecting said inner and outer structures, said connecting means conducting heat between said inner and outer structures, and preventing electrical breakdown between said structures due to said electric field, the connecting means having an axis of symmetry which extends radially from said centerline;

wherein, an electrical breakdown path is defined between said structures along a surface of said connecting means, and a corresponding heat conduction path is defined through said connecting means, said electrical breakdown path being substantially longer than said heat conduction path and in a direction opposite to said heat conduction path for a portion thereof;

wherein said connecting means further comprises a plurality of standoff assemblies, each of said standoff assemblies comprising:

a planar member and an outer peripheral wall, said planar member lying perpendicular to said axis of symmetry at a central point along an axial extent of said peripheral wall; and conductive plugs respectively coupling said planar member between said inner and outer structures.

18. The electron collector of claim 17, wherein said inner and outer structures are generally cylindrical shaped, with said inner structure concentrically disposed within said outer structure.

19. The electron collector of claim 17, wherein each said planar member is comprised of beryllium oxide ceramic material.

* * * * *